United States Patent [19]

Jacobson

[11] Patent Number: 4,457,726

[45] Date of Patent: Jul. 3, 1984

[54] SMALL WATERCRAFT STARTING ARRANGEMENT

[76] Inventor: Clayton J. Jacobson, P.O. Box 5338, Empire Landing RB, Parker, Ariz. 85344

[21] Appl. No.: 271,519

[22] Filed: Jun. 8, 1981

[51] Int. Cl.[3] ..... F02N 3/02

[52] U.S. Cl. ..... 440/85; 123/185 BB; 123/185 C; 123/179 SE

[58] Field of Search ..... 123/185 B, 185 BB, 185 C, 123/179 SE; 114/270; 440/85

[56] References Cited

U.S. PATENT DOCUMENTS

| | | | |
|---|---|---|---|
| 3,018,768 | 1/1962 | Thompson | 123/185 BB |
| 3,174,471 | 3/1965 | Welgate et al. | 123/185 C |
| 3,426,724 | 2/1969 | Jacobson | 114/270 |
| 3,826,220 | 7/1974 | Jacobson | 440/42 |
| 4,047,440 | 9/1977 | Carriera | 123/179 SE |
| 4,109,538 | 8/1978 | Glenday et al. | 123/179 SE |
| 4,257,367 | 3/1981 | Fujikawa et al. | 123/185 BB |

*Primary Examiner*—S. D. Basinger
*Assistant Examiner*—Thomas J. Brahan
*Attorney, Agent, or Firm*—Michael Bak-Boychuk

[57] ABSTRACT

In a water born vehicle of the type described in my prior U.S. Pat. No. 3,826,220 including a pivoted control handle extending rearwardly from the bow the improvement comprising a starting cable arrangement which may be selectively secured to the handle and through the pivotal motion of the handle may be articulated to crank the engine. The engine may be provided with a self-reeling starting cable spool with the cable thereof routed across pulleys to emerge at a point below the free end of the handle. The cable may then be selectively engaged to a hook on the handle which, when articulated, extracts the cable from the spool.

1 Claim, 3 Drawing Figures

SMALL WATERCRAFT STARTING ARRANGEMENT

BACKGROUND OF THE INVENTION

1. Field of the Invention

The present invention relates to starting cable arrangements, and more particularly to a starting cable useful with water borne vehicles.

2. Description of the Prior Art

In my prior U.S. Pat. No. 3,826,220 I have described a water borne vehicle provided with a pivotal handle which is articulated in a vertical plane above the engine compartment. Since that time I have found that the pivotal motion of this handle may be used to further advantage for starting the engine. In particular, I have found that pivoted members are uniquely suited for providing a large torque to crank an engine without disturbing the stability of a boat.

Heretofore, most two cycle engines used in water-borne vehicles, to conserve weight, were provided with rope or cable starting devices. With increased horsepower levels, compression ratios, and power-to-weight ratios, the necessary pull on the starting rope has increased to a point where vehicle stability becomes a limiting feature. Because most power plants in a boat are aligned with the rotational axis parallel to the longitudinal axis these substantial torque loads are developed transversely, i.e. in a direction of least stability. Thus in water borne vehicles having high power to weight ratios the practice engaged in in the past often required towing the stalled vehicle to shore and only upon reaching the shore would any attempts at restarting be made. Alternatively, the water borne vehicle would be tied to another boat for stability and only once thus secured would a restart be attempted.

Thus convenient techniques for manual starting of small craft marine engines have been sought in the past and it is such a technique that is described herein.

SUMMARY OF THE INVENTION

Accordingly, it is the general purpose and object of the present invention to provide a rope starting arrangement wherein a pivotal member of a boat may be used to effect the start.

Other objects of the invention are to provide a pulley arrangement on which the starting rope of a marine engine is passed to attach to a pivotal member for leverage.

Yet further objects of the invention are to provide a pulley arrangement at the output of a starting reel of a marine power plant through which mechanical advantage is obtained.

Briefly, these and other objects are accomplished within the present invention by providing a set of turning rollers or pulleys deployed through the hull around which the starting cord of a power plant is passed. These pulleys allow the cord to emerge at a position adjacent any one of the various control levers pivoted from the hull. Should an engine restart be desired the end of this starting cord may be attached to the lever and by pivotal articulation of the lever the rope may be retracted to turn over the engine. These features are particularly useful in small, high performance watercraft of the type described in my prior U.s. Pat. No. 3,826,220. This watercraft is provided with a hinged control handle and may be modified according to the present invention to include a set of turning pulleys across which the starting cord of the power plant is passed. The cord end is then aligned to emerge adjacent the free end of the handle. The user, then either prone, kneeling, or standing on the vehicle deck, may articulate the handle in a vertical direction, thus extending the starting rope. Since the opposing forces are in a vertical plane very little transverse disturbance occurs allowing a start in open sea.

Furthermore, the engagement of the starting rope to the handle arranges the steering and throttle controls in the grasp of the user while the starting stroke is produced. Thus the user is in full control over the vehicle as the engine is started.

DESCRIPTION OF THE SPECIFIC EMBODIMENT

Figure 1:
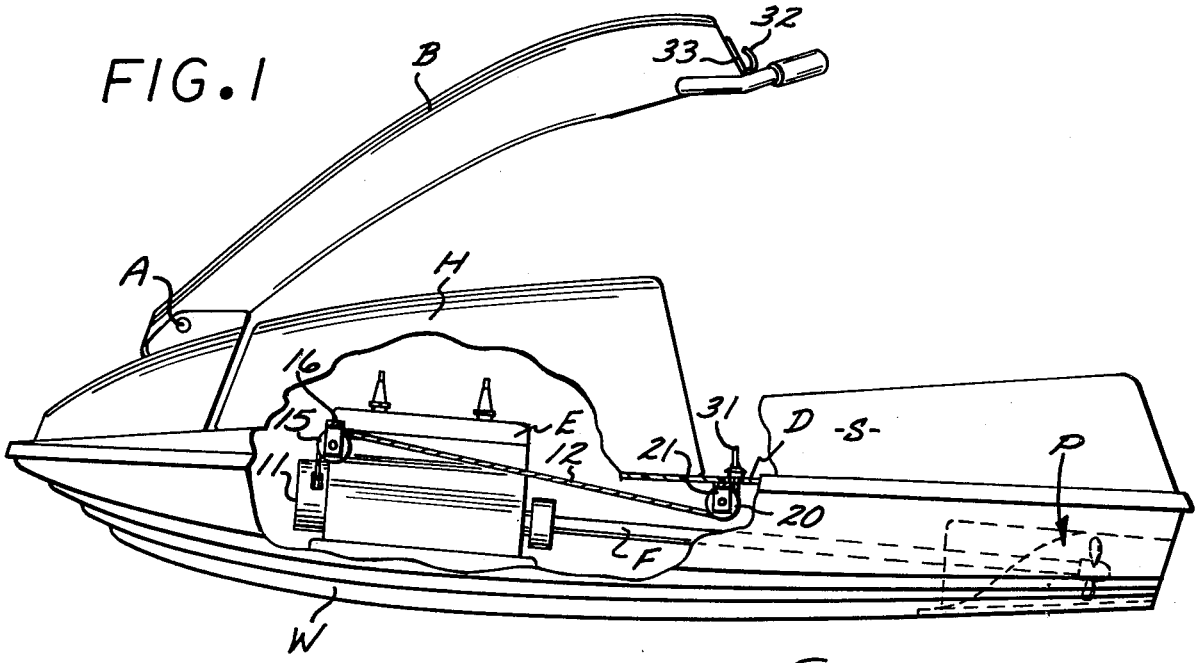
FIG. 1 is a side view, in partial section, of a water borne vehicle modified to include the inventive starting arrangement disclosed herein.
Figure 2:
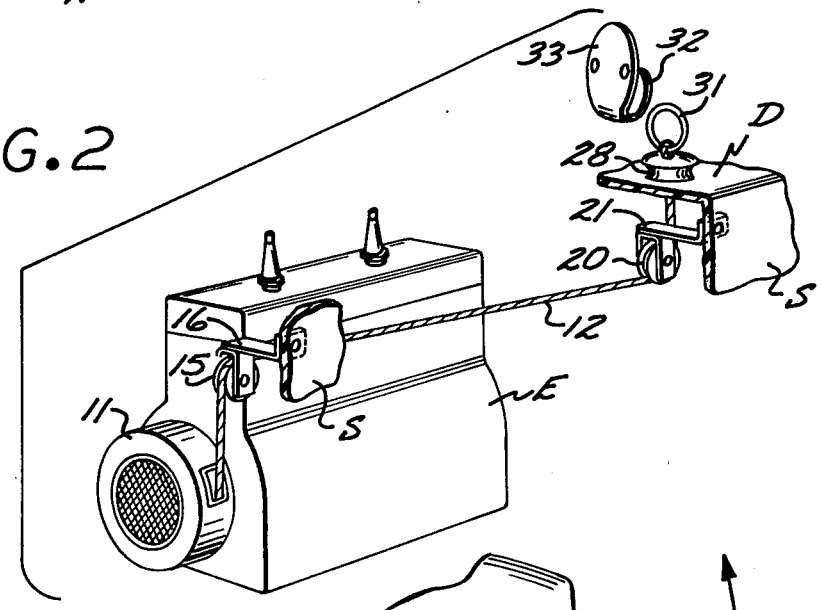
FIG. 2 is a perspective detail of one pulley arrangement constructed according to the invention herein.

As shown in FIGS. 1 and 2 a water borne vehicle W of the type described in my prior U.S. Pat. No. 3,826,220 includes an engine E mounted within an engine housing H and connected to a drive shaft F which, in turn, may operate any propulsive unit P advancing the vehicle W along the water surface. Pivoted above the housing H is a control handle C which, at the free end, terminates in a set of handlebars through which directional and throttle commands are applied. This and similar proximity of the pivoted handles relative the engine may be used to advantage according to the invention herein. More specifically, the engine E may be provided with a self-winding starting reel or recoil starter 11 around which a starting rope or cable 12 is wound up. Reel 11 may be secured to the crankshaft of the engine E in any conventional manner and may include the required ratchets for engagement thereof upon the extraction of the rope and for disengagement during the wind-up cycle.

In order to render the extraction of the rope 12 more convenient it is contemplated to pass a segment thereof over a first turning roller or pulley 15 supported on a bracket 16 which is attached to the side of the hull S of the boat W. This roller 15 then permits the rearward alignment of the remaining segments of rope 12 along the engine E to yet another roller 20 which, once again, is engaged to a bracket 21 mounted underneath the deck D. This last roller 20 allows for the turning of the rope 12 to an upward direction at the center of the water borne vehicle W at a location subjacent the deck D on which the user may kneel or stand. The rope or cable 12 may then pass through an opening 27 (provided with a vertical lip 28 to limit the ingestion of water therethrough) to emerge on the exterior. Once on the exterior the end of the rope 12 may be provided with an engagement ring 31 selectively engaged to a hook 32 extending from a bracket 33 which, in turn, attaches to the free end of the pivoted handle C.

The user, then standing on the deck D, may raise the handle, pivoting it around its pivot axis A and as the handle is pivoted rope 12 is extracted from the reel 11, turning the engine E.

It is to be noted that by virtue of this arrangement all the torques and moments may be aligned along a longitudinal plane having the highest degree of stability. Thus by selective deployment of the rollers or pulleys 15 and 20, the free end of the rope or cord 12 may be positioned proximate the center of the water borne vehicle W and a person standing adjacent thereto will impose minimal moments while starting the engine.

Figure 3:
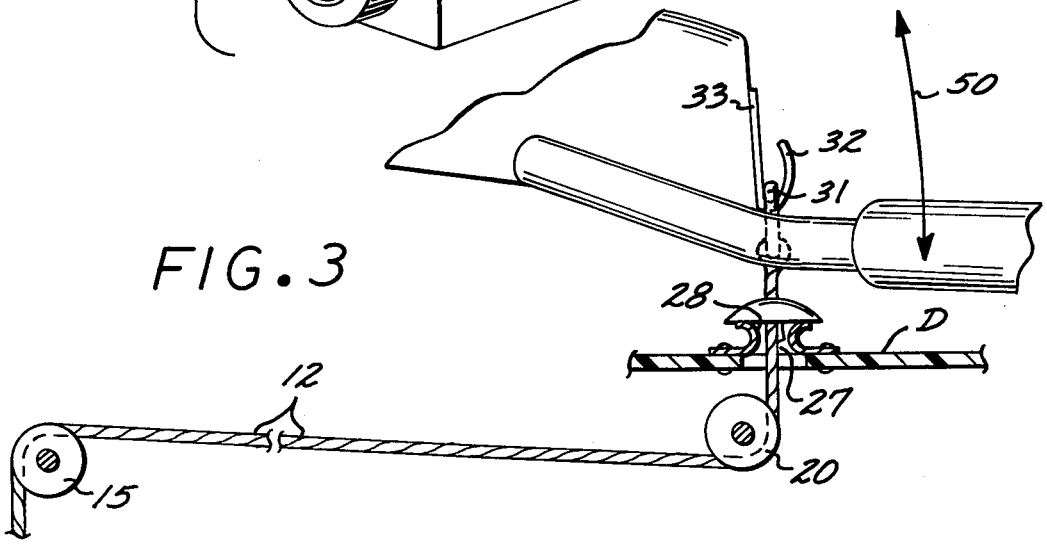
FIG. 3 is a side view detail of the pivotal stroke of an articulated member in a water borne vehicle used to provide the starting torque therein.

As shown in FIG. 3, the articulation of the handle in the plane defined by the arrow 50, is opposed by the deck D. While in the most convenient form the user will be kneeling or standing immediately adjacent the handle any aftward displacement affects only moments in the longitudinal mode. Utilizing this principle any other pivoted member aligned along the longitudinal plane may be similarly implemented to obtain the same benefits of localized deployment of starting torques.

While the foregoing example refers to a specific implementation of a handle structure within a vehicle described in my prior patent, it is to be understood that various alternatives may be similarly implemented. More specifically, various pivoted structures are frequently found on any conventional boat, e.g. pivoted tiller handles and the like, which may be used with similar advantage in the manner described. In each instance the pivotal restraint of the handle limits and locates the disposition of the starting moments and by appropriate selection these moments may be aligned such that minimum destabilization of the vehicle occurs. In addition, while the pulley arrangement shown herein is both well suited and convenient for the purpose described other mechanical arrangements may be utilized to achieve the same convenience. For example, one may mechanically couple the pivot of the moveable arm to the engine crankshaft by gearing or chain and no intent to limit the scope of the invention by the example selected is therefore expressed. Furthermore, while in the illustrations herein selection of shapes of the hook assembly 32 addresses the problems of safety, the hook 32 being expanded to a pommel-like structure to distribute any impact in case of an accident, other shapes may be utilized as dictated by these same considerations. Thus, while the embodiment disclosed is both well suited and best devised for the mode contemplated, other variances may be practiced according to the teachings herein.

Obviously, many modifications and changes may be made to the foregoing description without departing from the spirit of the invention. It is therefore intended that the scope of the invention be determined solely on the claims appended hereto.

What is claimed is:

1. In a waterborne vehicle of the type having a control handle horizontally articulated for controlling the direction of travel of said vehicle, said control handle being pivotally mounted on a substantially horizontal pivot at the forward end of said vehicle and aligned to extend to the free end thereof in a vertical arc about said pivot to a point rearward of said forward end to an alignment substantially central above said vehicle and an internal combustion engine mounted in said vehicle in substantial alignment below said point for propelling the vehicle through water, the improvement comprising:

engagement means releasably connected between said free end of said handle and said engine for applying turning moments to said engine upon the pivotal articulation of said handle;

said engagement means including a spring-loaded recoil starting reel mounted on said engine for storing a length of starting rope thereon engaged to said engine; and guide means for directing said rope towards the free end of said handle including turning rollers deployed in said vehicle for guiding said starting rope.

* * * * *